US010076834B1

(12) United States Patent
MacKinnon et al.

(10) Patent No.: US 10,076,834 B1
(45) Date of Patent: Sep. 18, 2018

(54) POCKET SOCKET SYSTEMS

(71) Applicants: Sterling MacKinnon, Kingston, WA (US); Jerry R. Ross, Kingston, WA (US)

(72) Inventors: Sterling MacKinnon, Kingston, WA (US); Jerry R. Ross, Kingston, WA (US)

( * ) Notice: Subject to any disclaimer, the term of this patent is extended or adjusted under 35 U.S.C. 154(b) by 388 days.

(21) Appl. No.: 14/855,367

(22) Filed: Sep. 15, 2015

Related U.S. Application Data

(63) Continuation-in-part of application No. 13/541,761, filed on Jul. 4, 2012.

(60) Provisional application No. 61/504,488, filed on Jul. 5, 2011.

(51) Int. Cl.
*B25G 1/08* (2006.01)
*B25B 13/46* (2006.01)

(52) U.S. Cl.
CPC ..... *B25G 1/085* (2013.01); *B25G 1/08* (2013.01); *B25B 13/463* (2013.01)

(58) Field of Classification Search
CPC ..... B25G 1/085; B25G 1/08; B25B 13/56
USPC ..... 81/177.4, 490, 177.85, 177.2; 206/378
See application file for complete search history.

(56) References Cited

U.S. PATENT DOCUMENTS 1,289,558 A * 12/1918 Sedgley ..... B25B 13/56 81/124.5
1,371,350 A * 3/1921 Campbell ..... B25B 13/463 81/177.4
1,469,589 A * 10/1923 Palmer ..... B25B 13/06 81/124.4
1,662,424 A * 3/1928 Judge ..... B25B 13/56 81/177.4
1,724,491 A * 8/1929 Mandl ..... B25B 13/463 81/124.6
2,776,589 A * 1/1957 Gregory ..... B25B 13/56 81/177.4
4,043,230 A * 8/1977 Scrivens ..... B25B 13/56 81/177.2
4,352,307 A 10/1982 Martinmaas
4,960,016 A * 10/1990 Seals ..... B25F 1/003 7/100
6,199,454 B1 * 3/2001 Bergbower ..... B25B 13/461 81/177.4
6,401,577 B1 6/2002 Peters
6,634,262 B2 * 10/2003 Malchus ..... B25B 15/04 81/177.4
7,171,874 B1 * 2/2007 Huang ..... B25B 13/461 403/329

(Continued)

*Primary Examiner* — Bryan R Muller
(74) *Attorney, Agent, or Firm* — RG Patent Consulting, LLC; Rachel Gilboy

(57) ABSTRACT

Pocket Socket is a portable tool that combines a ratchet and sockets that enables individuals to simply grab one item, instead of having a handful of sockets and a ratchet stuffed inside of a toolbox. This innovative product can eliminate individuals grabbing the wrong-sized sockets, as they can have access to any-sized sockets needed for the job. Individuals can easily store this tool in their pockets, a toolbox, or a holster without the chance of it becoming lost or scattered throughout the other contents. This product can provide professional mechanics, carpenters, and do-it-yourselfers with a convenient, all-in-one tool to complete the required job.

7 Claims, 5 Drawing Sheets

(56) References Cited

U.S. PATENT DOCUMENTS

2004/0177733 A1* 9/2004 Peters ..... B25G 1/085
81/490

* cited by examiner

POCKET SOCKET SYSTEMS

CROSS-REFERENCE TO RELATED APPLICATION

This application is a continuation-in-part of U.S. application Ser. No. 13/541,761, which is related to and claims priority from prior provisional application Ser. No. 61/504,488, filed Jul. 5, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of tools and more specifically relates to a pocket socket system.

2. Description of the Related Art

Many individuals use various tools to aid them in performing work tasks. Tools such as sockets and a ratchet tools may be used for tightening and loosening fasteners. Individuals may keep these items in a toolbox, a drawer, or in their pockets. No matter where these items are stored, they can become disorganized or lost among other items, making it difficult for people to simply grab what is needed. Also, some people may end up grabbing the wrong-sized sockets from their toolbox and not realize it until they start the job. This can be frustrating and time consuming, as the person has to go back to wherever his or her toolbox is and retrieve the correct sockets. It is undesirable to have tool assemblies in a disorganized fashion for storage and/or use. A more convenient means is desirable.

Various attempts have been made to solve the abovementioned problems such as those found in U.S. Pat. Nos. 6,199,454; 4,352,307; 7,171,874; 6,634,262; 6,401,577; and 4,960,016. This prior art is representative of socket/ratchet tools. None of the above inventions and patents, taken either singly or in combination, is seen to describe the invention as claimed.

Ideally, a pocket socket system should be user-friendly, logically ordered for convenient use and storage, portable and, yet would operate reliably and be manufactured at a modest expense. Thus, a need exists for a reliable pocket socket system to avoid the abovementioned problems.

BRIEF SUMMARY OF THE INVENTION

In view of the foregoing disadvantages inherent in the known socket/ratchet tools art, the present invention provides a novel pocket socket system. The general purpose of the present invention, which will be described subsequently in greater detail is to provide efficiency and convenience in use of socket/ratchet tool systems.

Pocket Socket is a portable tool (assembly) that combines a ratchet and sockets that enables individuals to simply grab a unitized tool, instead of having a handful of sockets and a ratchet stuffed inside of a toolbox. This innovative product can effectively eliminate individuals grabbing the wrong-sized sockets, as they can have access to any-sized sockets needed for the job. Individuals can easily store this tool in their pockets, a toolbox, or a holster without the chance of it becoming lost or scattered throughout the other contents of a box or the like. This product can provide professional mechanics, carpenters, and do-it-yourselfers with a convenient, all-in-one tool to complete the required job, saving time and money.

A socket ratchet tool system is disclosed herein in a preferred embodiment comprising a socket ratchet tool assembly comprising: a ratchet wrench having a shaft (with a proximate end and a distal end); and a head (with a gear and pawl assembly and a lug); a plurality of sockets (each with a lug-receiver and a nut-engaging cavity), the sockets each comprising an outer periphery diameter and an inner diameter (a nut-engaging cavity—not circular, but rather formed to a 6 or 12 point socket profile); a hollow-handle (with a first end and a second end); and an endcap preferably comprising a knurled grip.

The shaft of the ratchet wrench preferably comprises an outside dimension of less than an inner squared-width of the lug-receiver(s) (in the sockets) such that the shaft of the ratchet wrench is able to fit through the plurality of sockets allowing the sockets to be able to be stored about the shaft in series sequentially (preferably from largest to smallest, respectively from the distal to the proximate end of the shaft.) The sockets are able to be removed from the proximate end of the shaft when desired, one at a time or all of the sockets removed. Each of the sockets comprise a different sized nut-engaging cavity; yet the sockets each comprise a common sized lug-receiver to fit the lug on the head of the wrench.

The socket, when removed, is able to be mounted on the lug of the head of the ratchet wrench; the lug engaging the lug-receiver of the socket such that when manipulated by a user causes the gear and pawl assembly to rotate the lug (clockwise or counter-clockwise to loosen or tighten) and the socket, the nut-engaging cavity of the socket friction-engaging a nut to rotate the nut in relation to a fastener. In this way the present invention may be used in the capacity of a socket wrench, but in a much more efficient fashion.

Relationally, the distal end on the shaft is located adjacent the head and the proximate end of the shaft is located adjacent the first end; the shaft passing into the hollow-handle. The shaft comprises a square cross-section in preferred embodiments and is solid throughout the member to withstand forces applied. The hollow-handle is cylindrical to negate sharp edges when using the device (preferred over gripping onto a square shaft.) This creates comfort in use such that the user is able to use the present invention for extended durations. The first end of the hollow-handle is located opposing the second end of the hollow-handle and the hollow-handle comprises a height and inner-diameter sufficient to enclose those sockets whose nut-engaging cavity is too small to slide over the shaft cross-section when in storage and when in-use. The endcap is removably attachable to the second end of the hollow-handle and may act as a stop to prevent the sockets from movement from the shaft.

The outer periphery diameter of the sockets are able to fit in the hollow-handle such that at least one of the sockets are able to be stored therein, the shaft simultaneously passing through the sockets; wherein when the sockets are able to be placed about the shaft in a sequential relationship. The endcap prevents the sockets from falling from-within the shaft of the ratchet wrench when the endcap is attached to the hollow-handle, as mentioned. The socket ratchet tool assembly of the socket ratchet tool system is useful to manipulate nut(s) to remove the nuts from fastener(s) and install the nuts to fastener(s) and the socket ratchet tool assembly thus comprises a 'self-contained' socket ratchet tool system when stored and used.

A kit is disclosed herein including a ratchet wrench; a plurality of sockets; a hollow-handle; and an endcap; in combination delivering a socket ratchet tool assembly that is readily portable, easy to store and use.

A method of use for a socket ratchet tool system is also described herein comprising the steps of: detaching the hollow-handle or endcap from a socket ratchet tool assembly; removing at least one socket from a shaft of the socket ratchet tool assembly; replacing the hollow-handle or the endcap; coupling the socket to the shaft (via the lug); and using the socket in combination with the shaft to manipulate a nut attached to a fastener to loosen or tighten the nut and/or fastener. An additional step may include storing the socket ratchet tool assembly in a garment when not in use. Other additional steps my include changing out the socket for another size and the like.

The present invention holds significant improvements and serves as a pocket socket system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, pocket socket system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a socket/ratchet tool device and more particularly to a pocket socket tool and system as used to improve the convenience in using sockets and ratchet tools for performing maintenance and service tasks.

Generally speaking, Pocket Socket combines a ratchet and various-sized sockets into one tool, allowing individuals to carry one item around instead of toting an entire toolbox. This unique product can comprise a standard ratchet tool with attached sockets. The ratchet's shaft can be turned and milled square to the drive size. Sockets of all different sizes can be strung on the shaft. The sockets can be attached via a hollow handle that can also hold sockets. A quick-release assembly, called a "neckcheck," can fit closely to a spindle into the handle base with a neck that can accommodate the drive size and can attach to the handle with a thread, bayonet, or o-ring attachment. This assembly can enable users to undo the handle, pull off the needed socket, and quickly replace the handle.

Figure 1:
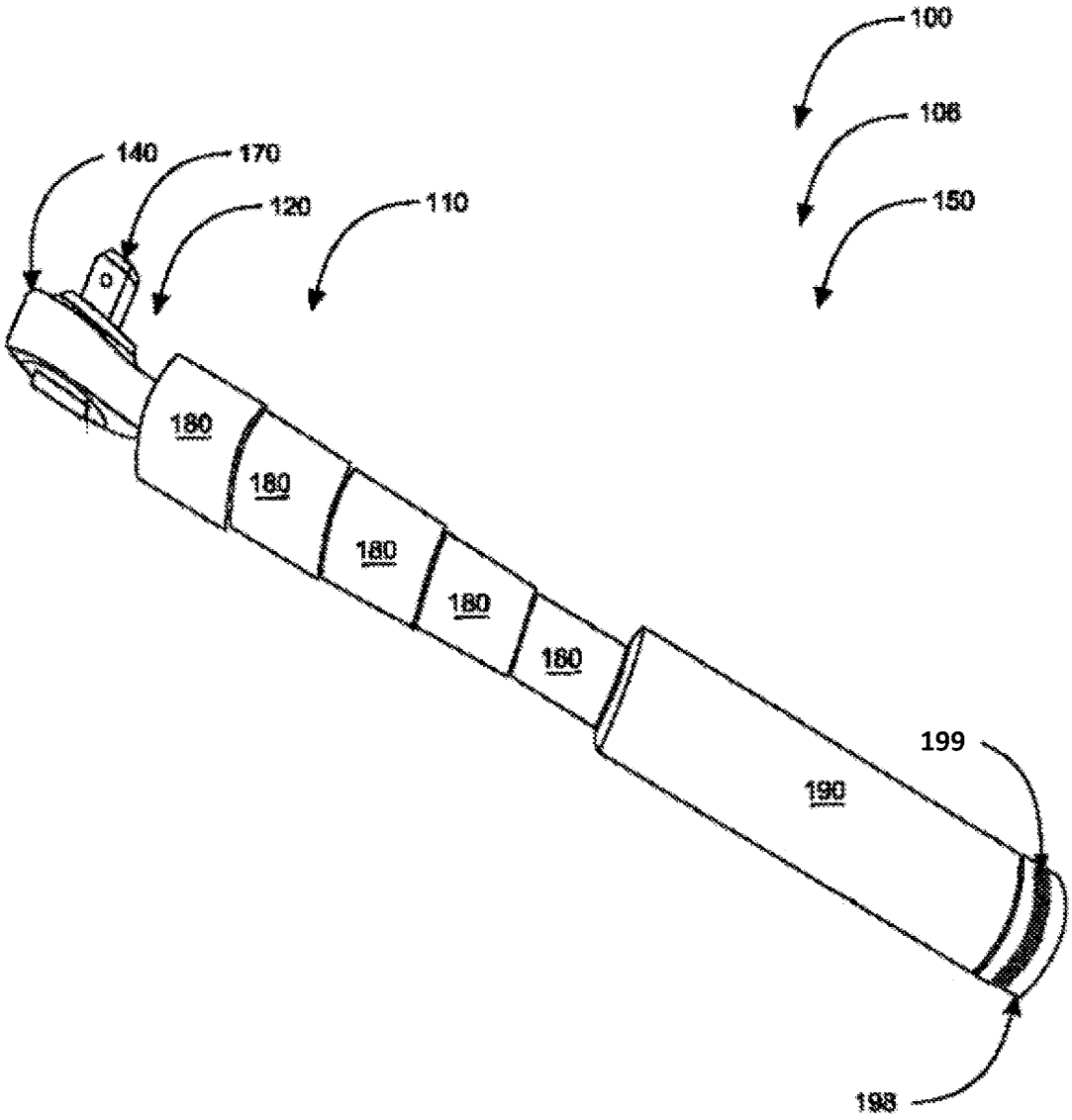
FIG. 1 shows a perspective view illustrating a pocket socket assembly in a stored condition according to an embodiment of the present invention.

Referring to the drawings by numerals of reference there is shown in FIG. 1, a perspective view illustrating pocket socket assembly 110 in stored condition 150 according to an embodiment of the present invention.

Figure 2:
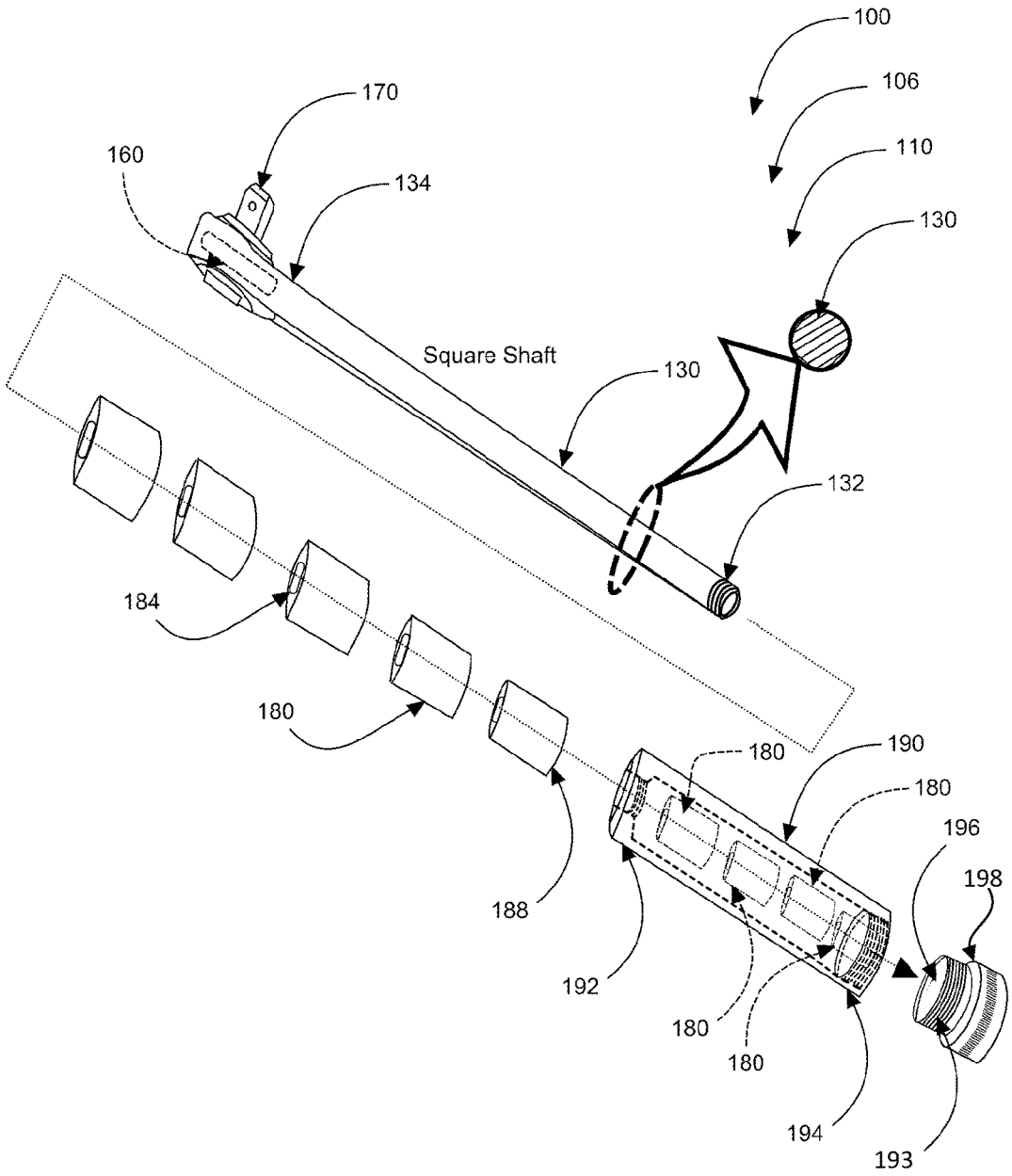
FIG. 2 is an exploded view illustrating the pocket socket assembly according to an embodiment of the present invention of FIG. 1.
Figure 3:
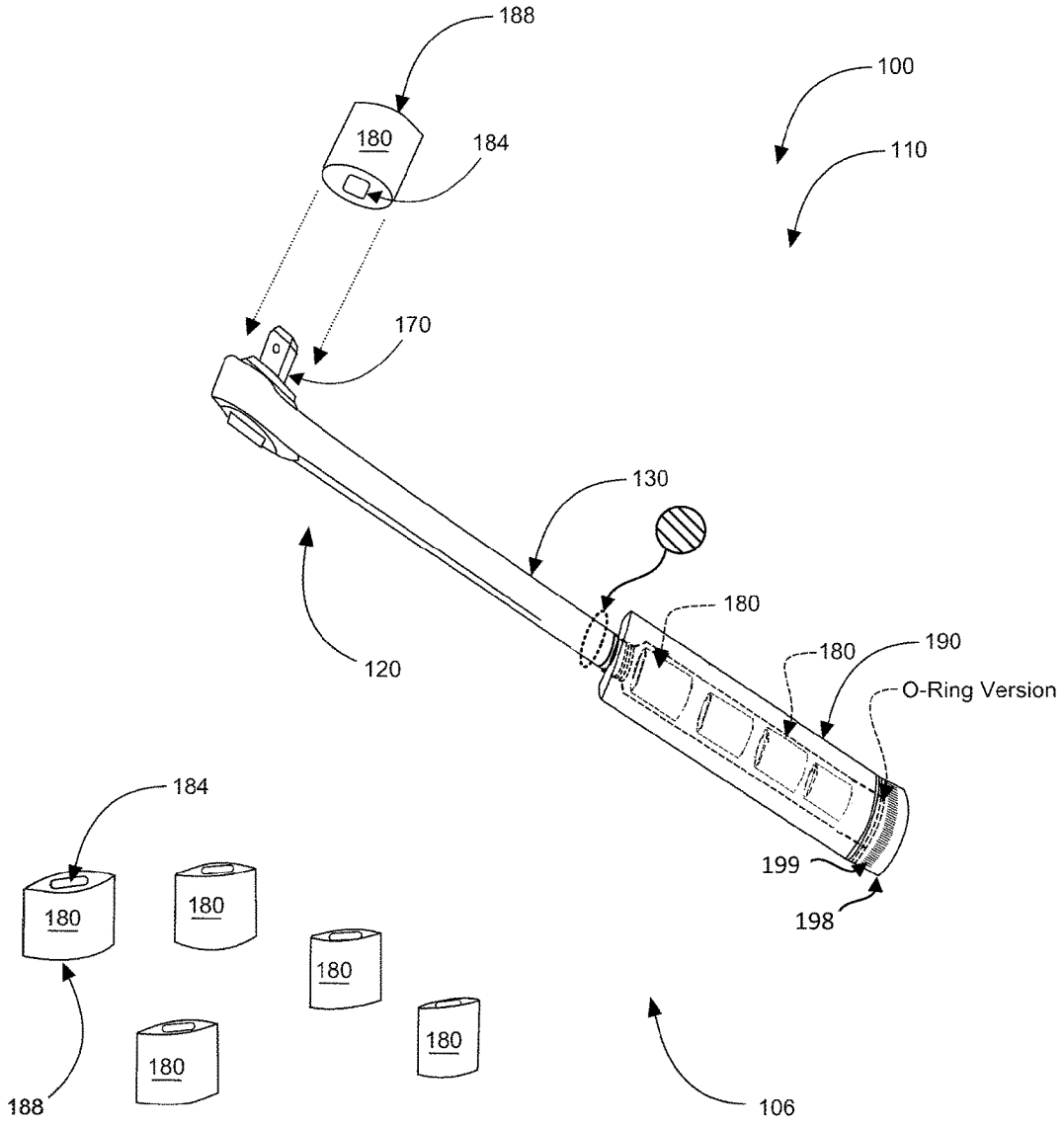
FIG. 3 is a perspective view illustrating the pocket socket assembly being prepared for an in-use condition according to an embodiment of the present invention of FIG. 1.

Socket ratchet tool system 100 comprises a socket ratchet tool assembly 110; socket ratchet tool assembly 110 comprising: ratchet wrench 120 having shaft 130 wherein shaft 130 has a circular cross-section (as shown in FIGS. 2 and 3) with distal end 134 and a threaded proximate end 132 (as shown in FIGS. 2 and 3), an outside shape, a top portion adjacent the distal end having a square cross-section, a bottom portion adjacent the proximate end having the circular cross-section; and head 140 (with gear and pawl assembly 160 and lug 170); a plurality of first sockets 180 (each with lug-receiver 184 having an outer squared-width and nut-engaging cavity 188, first sockets 180 each comprising an outer periphery diameter) and a lug-receiver including an inner squared-width adapted to fit over the outer squared-width of the lug, and releasably engage with the lug; and wherein the lug-receiver is located on one end of the socket; a nut-engaging cavity including a shape adapted to engage a nut of a fastener; and wherein the nut-engaging cavity is located on an opposite end of said socket; and an outer periphery diameter, wherein the inner squared-width of the lug-receiver is larger than the outside dimension of the shaft, wherein the shape of the nut-engaging cavity has an inner dimension larger than the outside dimension of the shaft; wherein each of the plurality of first sockets 180 are adapted to receive the shaft through the lug-receiver and the nut-engaging cavity, such that the plurality of first sockets 180 can be stored upon the shaft in a end-to-end configuration; and wherein the plurality of first sockets 180 can be retained upon the shaft of the ratchet wrench when the hollow-handle is connected to the shaft of the ratchet wrench. Preferably, there are five first sockets, wherein the shape of the nut-engaging cavity of successive ones of the plurality of first sockets have differing dimensions adapted to fit upon respective differing dimensions of nuts of various fasteners. Furthermore, there are a plurality of second sockets 180, each including a lug-receiver including an inner squared-width adapted to fit over the outer squared-width of the lug, and releasably engage with the lug; and wherein the lug-receiver is located on one end of the socket; a nut-engaging cavity including a shape adapted to engage a nut of a fastener; and wherein the nut-engaging cavity is located on an opposite end of the socket; and an outer periphery diameter; wherein the inner squared-width of said lug-receiver is larger than the outside dimension of the shaft; wherein the shape of the nut-engaging cavity has an inner dimension smaller than the outside dimension of the shaft; wherein the outer periphery diameter is smaller than the interior diameter of the hollow interior cylindrical volume of the hollow-handle; wherein each of the plurality of second sockets 180 are adapted to be stored within the hollow interior cylindrical volume of the hollow-handle in a end-to-end configuration; and wherein the plurality of second sockets 180 can be retained within the hollow-handle when the endcap is attached to the second end of the hollow-handle. Preferably, there are four second sockets, wherein the shape of the nut-engaging cavity of successive ones of the plurality of second sockets have differing dimensions adapted to fit upon respective differing dimensions of nuts of various fasteners. Furthermore there is a hollow-handle 190 wherein the first and second sockets 180 reside both within hollow-handle 190 and outside of shaft 130—thus at least enabling sockets within handle and outside of handle (with first end 192 and second end 194); the hollow-handle includes a first end including an aperture therethrough including threads thereon adapted to releasably engage with the threads of the proximate end of the shaft, such that the hollow-handle can be releasably attached to the ratchet wrench; a second end including an aperture therethrough including threads thereon, wherein the second end is located opposite from the first end; and a cylindrical wall connected between said first end and said second end, wherein the first end, the second end, and the cylindrical wall form a hollow interior cylindrical volume having an interior diameter; and endcap 198 including threads thereon adapted to releasably engage with the threads of the second end, such that the hollow interior cylindrical volume can be selectively opened and closed. The present invention may be easily assembled and disassembled while in use. Wherein hollow-handle 190 has mating threads of threaded proximate end 132 of shaft 130—situated at first end 192 as shown in FIGS. 2 and 3. And wherein second end 194 of hollow-handle 190 has mating threads for shaft receiver 196 portion of Endcap 198 as shown in FIG. 2. Further, hollow-handle 190 is sufficiently hollow that a plurality of sockets 180 can reside within hollow-handle 190 as shown in FIGS. 2 and 3.

Shaft 130 of ratchet wrench 120 comprises an outside dimension of less than an inner squared-width of lug-receiver(s) 184 in preferred embodiments such that shaft 130 of ratchet wrench 120 is able to fit through plurality of sockets 180, providing that sockets 180 are able to be stored about (on) shaft 130. Sockets 180 are able to be removed from proximate end 132 of shaft 130. Socket(s) 180 when removed are able to be mounted on lug 170 of head 140 of ratchet wrench 120 for use, lug 170 engaging lug-receiver 184 of socket 180 such that when manipulated by a user causes gear and pawl assembly 160 to rotate lug 170 and socket 180; nut-engaging cavity 188 of socket 180 friction-engaging a nut to rotate nut in relation to a fastener. In this way the present invention is able to engage a fastener and tighten or loosen it via force applied to shaft 130, shaft 130 used as a lever to impart mechanical advantage.

Distal end on shaft 130 is located adjacent head 140 and proximate end 132 of shaft 130 is located adjacent endcap 198, shaft passing through hollow-handle 190 into shaft receiver 196 (in certain embodiments.) Shaft 130 is not directly adjacent hollow-handle 190 as socket 180 (walls between outer periphery and inner periphery) are located between the two, thus filling the interior void permitting metal to metal to metal contact to avoid any 'slop' in movement. The present invention is preferably manufactured of alloyed metals; however upon reading this specification, it should be appreciated that, under appropriate circumstances, considering such issues as user preferences, design preference, structural requirements, marketing preferences, cost, available materials, technological advances, etc., other materials and arrangements such as, for example, composites, other metals or combinations thereof, types of levering means, shapes, sizes, etc., may be sufficient.

Figure 4:
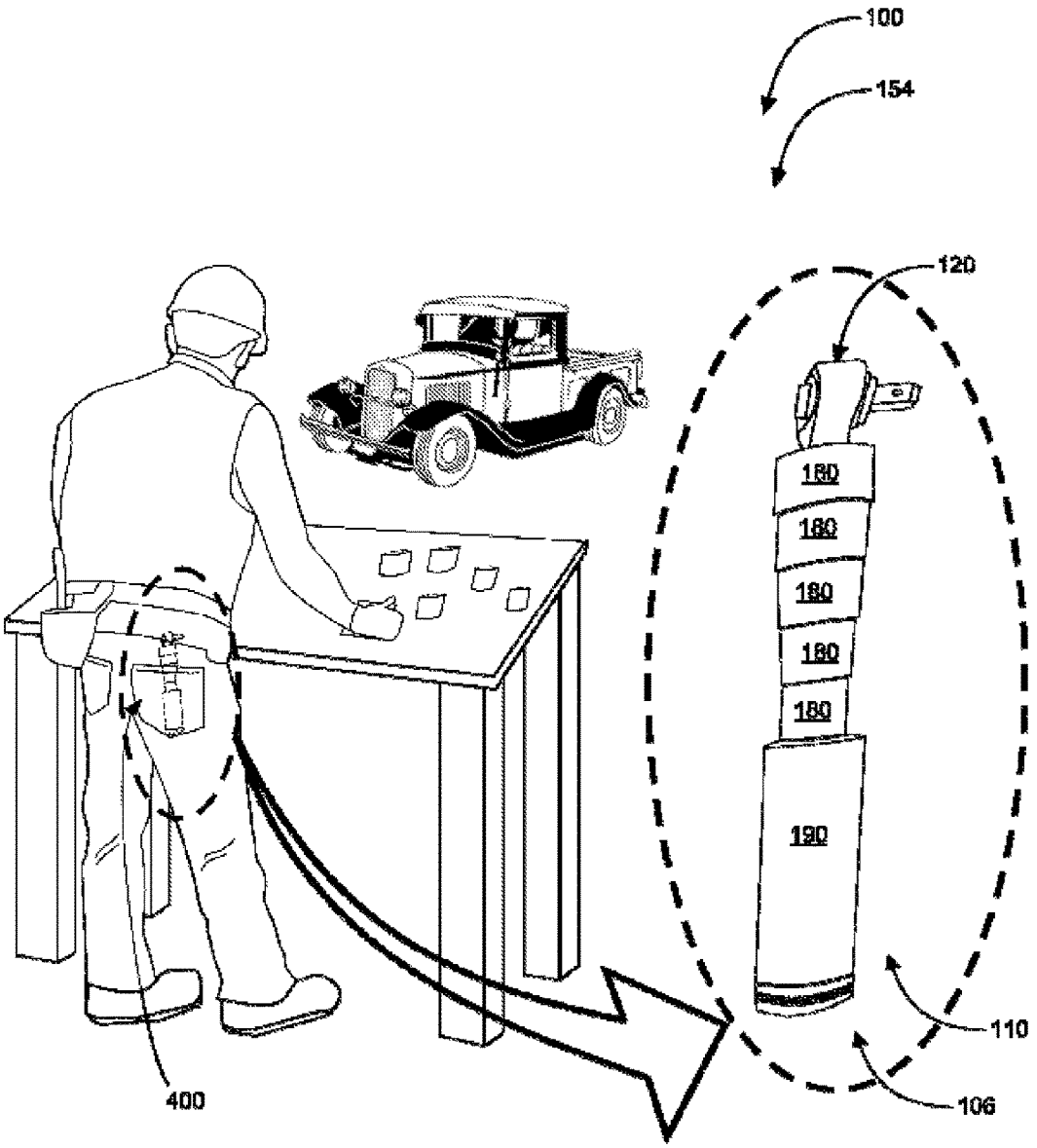
FIG. 4 is a perspective view illustrating the pocket socket assembly as stored in a garment pocket according to an embodiment of the present invention of FIG. 1.

Outer periphery diameter of sockets 180 are able to fit in (and sequentially above) hollow-handle 190 such that at least one of sockets 180 are able to be stored therein. The first sockets 180 are also able to remain on shaft 130 sequentially (in series) above hollow-handle 190, as shown in FIGS. 1 and 4. First end 192 of hollow-handle 190 is located opposing second end 194 of hollow-handle 190. Endcap 198 is removably attachable to second end 194 of hollow-handle 190. Endcap 198 (when in place) prevents the second sockets 180 from falling out of hollow-handle 190, thus acting as a 'stop'.

Socket ratchet tool assembly 110 of socket ratchet tool system 100 is useful to manipulate nut(s) to remove nuts from fastener(s) and install nut(s) to fastener(s); socket ratchet tool assembly 110 comprising a convenient 'self-contained' socket ratchet tool system 100 when stored and in use.

Referring now to FIG. 2, an exploded view illustrating pocket socket assembly 110 according to an embodiment of the present invention of FIG. 1.

Each of the plurality of the first and second sockets 180 preferably comprise a different sized nut-engaging cavity 188 such as for example ½", 9/16", ⅝" and the like—metric versions may also be used or combinations thereof. Sockets 180 each comprise a common sized lug-receiver 184 such that lug 170 may fit (removably couple) to all sockets 180. The first sockets 180 are placed about shaft 130 in a sequential relationship, also shown in FIGS. 1 and 4.

Endcap 198 may comprise threads in certain embodiments, as shown in the present FIG. 2. Endcap 198 preferably comprises a knurled grip 186 to provide enhanced gripping ability for user. Shaft 130 preferably comprises a square cross-section; however may comprise oval or circular profiles in alternate embodiments. Endcap 198 may further comprise a NeckCheck 182. NeckCheck 182 may comprise a quick release in certain embodiments or NeckCheck 182 may comprise an abbreviated thread reducing a number of rotations to remove from hollow-handle 190, as shown in the present FIG. 2. NeckCheck 182 may use rubber O-rings and snap on and off hollow handle 190 in alternate embodiments. NeckCheck 182 may alternately comprise a magnetic ring to hold hollow handle 182 on shaft 130.

Referring now to FIG. 3, a perspective view illustrating pocket socket assembly 110 being prepared for an in-use condition 154 according to an embodiment of the present invention of FIG. 1. Shaft 130 may comprises a circular cross-section, as shown. Shaft 130 is solid in this and other embodiments to provide maximum longevity and strength. Shaft 130 is shown in relation to hollow handle 182. Shaft 130 is shown with the first sockets 180 removed therefrom.

Indicator arrows illustrate the placement of socket 180 onto lug 170, lug 170 may or may not comprise a detent.

Referring now to FIG. 4, a perspective view illustrating pocket socket assembly 110 as stored in garment pocket 400 according to an embodiment of the present invention of FIG. 1.

Hollow-handle 190 comprises a height and inner-diameter sufficient to enclose at least a portion of plurality of second sockets 180. Hollow-handle 190 may comprise threads for receiving threads 132 for receiving shaft 130, permitting temporary coupling of endcap 198 to shaft 130 to provide socket ratchet tool assembly 110. Hollow-handle 190 when assembled to socket ratchet tool assembly 110 provides a mass-increaser and a grip-diameter increaser such that greater torque and grip is able to be achieved. Pocket socket assembly 110 may be readily stored in garment pocket 400, as shown.

Kit 106 may include ratchet wrench 120; a plurality of first and second sockets 180; hollow-handle 190; and endcap 198 in combination delivering a socket ratchet tool assembly 110 that is readily portable, easy to store and use. Kit 106 is also shown in FIG. 2. Kit 106 may comprise a set of user instructions. Socket ratchet tool system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different socket (metric/standard) combinations, parts may be sold separately, etc., may be sufficient.

Figure 5:
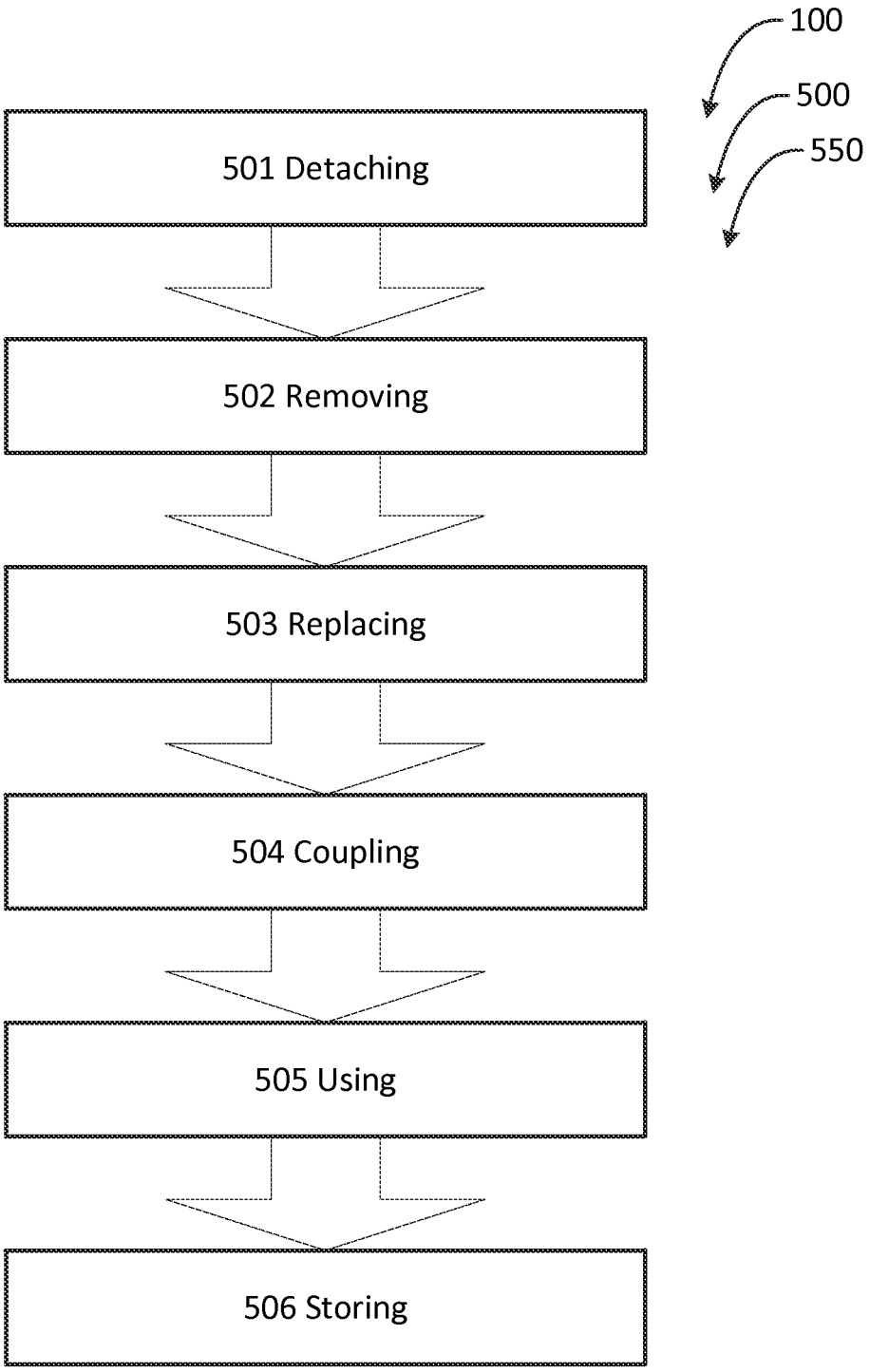
FIG. 5 is a flowchart illustrating a method of use for the pocket socket assembly according to an embodiment of the present invention of FIGS. 1-4.

Referring now to FIG. 5, a flowchart 550 illustrating a method of use 500 for pocket socket assembly 110 according to an embodiment of the present invention of FIGS. 1-4.

A method of use 500 for a socket ratchet tool system 100 comprises the steps of: step one 501 detaching an endcap 198 from hollow-handle 190 or detaching shaft 130 from hollow-handle 190; step two 502 removing at least one first or second socket 180 from either hollow-handle 190 or shaft 130 of socket ratchet tool assembly 110; step three 503 replacing hollow-handle 190 or endcap 198; step four 504 coupling socket 180 to shaft 130; and step five 505 using socket 180 in combination with shaft 130 to manipulate a nut attached to a fastener. Method 500 may further comprise the step six 506 of storing socket ratchet tool assembly 110 in a garment (garment pocket 400) when not in use.

It should be noted that step 506 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A socket ratchet tool system comprising:

a ratchet wrench having:
- a shaft including:
  - a distal end;
  - a proximate end including:
    - a plurality of threads thereon;
  - an outside dimension;
  - an outside shape;
  - a top portion adjacent said distal end
    - wherein said top portion has a square cross-section; and
  - a bottom portion adjacent said proximate end;
    - wherein said bottom portion has a circular cross-section;
- a head including:
  - a lug;
    - wherein said lug has an outer squared-width;
  - wherein said head is adapted to house a gear and pawl assembly adapted to mechanically rotate said lug; and
  - wherein said head is attached to said distal end of said shaft;

a hollow-handle including:
- a first end including:
  - an aperture therethrough including threads thereon adapted to releasably engage with said threads of said proximate end of said shaft, such that said hollow-handle can be releasably attached to said ratchet wrench;
- a second end including:
  - an aperture therethrough including threads thereon;
  - wherein said second end is located opposite from said first end; and
- a cylindrical wall;
  - wherein said cylindrical wall is connected between said first end and said second end;
- wherein said first end, said second end, and said cylindrical wall form a hollow interior cylindrical volume having an interior diameter; and
- an endcap;
  - wherein said endcap includes threads thereon adapted to releasably engage with said threads of said second end, such that said hollow interior cylindrical volume can be selectively opened and closed;

a plurality of first sockets, each including:
- a lug-receiver including:
  - an inner squared-width adapted to fit over said outer squared-width of said lug, and releasably engage with said lug; and
  - wherein said lug-receiver is located on one end of said socket;
- a nut-engaging cavity including:
  - a shape adapted to engage a nut of a fastener; and wherein said nut-engaging cavity is located on an opposite end of said socket; and an outer periphery diameter;

wherein said inner squared-width of said lug-receiver is larger than said outside dimension of said shaft;

wherein said shape of said nut-engaging cavity has an inner dimension larger than said outside dimension of said shaft;

wherein each of said plurality of first sockets are adapted to receive said shaft through said lug-receiver and said nut-engaging cavity, such that said plurality of first sockets can be stored upon said shaft in a end-to-end configuration; and wherein said plurality of first sockets can be retained upon said shaft of said ratchet wrench when said hollow-handle is connected to said shaft of said ratchet wrench; and a plurality of second sockets, each including:

a lug-receiver including:

an inner squared-width adapted to fit over said outer squared-width of said lug, and releasably engage with said lug; and wherein said lug-receiver is located on one end of said socket;

a nut-engaging cavity including:

a shape adapted to engage a nut of a fastener; and wherein said nut-engaging cavity is located on an opposite end of said socket; and an outer periphery diameter;

wherein said inner squared-width of said lug-receiver is larger than said outside dimension of said shaft;

wherein said shape of said nut-engaging cavity has an inner dimension smaller than said outside dimension of said shaft;

wherein said outer periphery diameter is smaller than said interior diameter of said hollow interior cylindrical volume of said hollow-handle;

wherein each of said plurality of second sockets are adapted to be stored within said hollow interior cylindrical volume of said hollow-handle in a end-to-end configuration; and wherein said plurality of second sockets can be retained within said hollow-handle when said endcap is attached to said second end of said hollow-handle.

2. The socket ratchet tool system of claim 1, wherein said shape of said nut-engaging cavity of successive ones of said plurality of first sockets have differing dimensions adapted to fit upon respective differing dimensions of nuts of various fasteners.

3. The socket ratchet tool system of claim 1, wherein said shape of said nut-engaging cavity of successive ones of said plurality of second sockets have differing dimensions adapted to fit upon respective differing dimensions of nuts of various fasteners.

4. The socket ratchet tool system of claim 2, wherein said shape of said nut-engaging cavity of successive ones of said plurality of second sockets have differing dimensions adapted to fit upon respective differing dimensions of nuts of various fasteners.

5. The socket ratchet tool system of claim 4, wherein there are five first sockets and four second sockets.

6. The socket ratchet tool system of claim 2, wherein said inner squared-width of said lug-receiver of each of said first sockets and said second sockets are equal.

7. The socket ratchet tool system of claim 3, wherein said inner squared-width of said lug-receiver of each of said first sockets and said second sockets are equal.

* * * * *